United States Patent [19]

Ochs

[11] Patent Number: 5,031,787

[45] Date of Patent: Jul. 16, 1991

[54] LOW HEIGHT FLOATING DISK CLOSURE

[75] Inventor: Charles S. Ochs, Lancaster, Ohio

[73] Assignee: Anchor Hocking Packaging Company, Lancaster, Ohio

[21] Appl. No.: 535,756

[22] Filed: Jun. 8, 1990

Related U.S. Application Data

[63] Continuation-in-part of Ser. No. 401,999, Sep. 1, 1989, Pat. No. 4,993,572, and Ser. No. 402,211, Sep. 1, 1989, abandoned.

[51] Int. Cl.[5] ..... B65D 41/04

[52] U.S. Cl. ..... 215/276; 215/260; 215/350

[58] Field of Search ..... 215/252, 258, 260, 262, 215/341, 346, 349, 350, 351, 276

[56] References Cited

U.S. PATENT DOCUMENTS

| | | | |
|---|---|---|---|
| 2,026,889 | 1/1936 | Gray et al. | 215/351 X |
| 2,039,757 | 5/1936 | Vontill | 215/350 X |
| 3,913,771 | 10/1975 | Acton et al. . | |
| 3,913,772 | 10/1975 | Ochs . | |
| 4,109,815 | 8/1978 | Collins, III | 215/341 X |
| 4,381,840 | 5/1983 | Ostrowsky | 215/350 X |
| 4,462,502 | 7/1984 | Luenser et al. | 215/350 X |
| 4,473,163 | 9/1984 | Geiger . | |
| 4,560,076 | 12/1985 | Boik . | |
| 4,629,083 | 12/1986 | Druitt | 215/350 X |
| 4,679,696 | 7/1987 | Bonnenfant et al. . | |
| 4,694,969 | 9/1987 | Granst . | |
| 4,694,970 | 9/1987 | Hayes | 215/252 |
| 4,723,685 | 2/1988 | Fillmore et al. | 215/350 X |
| 4,770,306 | 9/1988 | Szczesniak . | |
| 4,813,561 | 3/1989 | Ochs | 215/276 X |
| 4,880,127 | 11/1989 | Doi | 215/252 |

FOREIGN PATENT DOCUMENTS 1000164 4/1965 United Kingdom .

*Primary Examiner*—Stephen Marcus
*Assistant Examiner*—Vanessa M. Roberts
*Attorney, Agent, or Firm*—Wood, Herron & Evans

[57] ABSTRACT

A closure having an axially movable insert disk which is lifted by a bead around the inside of the closure shell to open a sealed container. When the closure is in sealing position on the container, the lifting bead lies below the top of external threading on the container, and at the top of cooperating internal threading of the closure skirt. The bead has an inside diameter greater than that of the closure threading, and can move upwardly past the external threading on the container. The overall heights of the closure and the container finish can thereby be reduced and less material used.

24 Claims, 2 Drawing Sheets

LOW HEIGHT FLOATING DISK CLOSURE

Related Applications

FIELD OF THE INVENTION

This invention relates to composite closures of the type having a floating insert disk for sealing a container.

This application is a continuation-in-part of my copending applications Ser. No. 401,999, filed Sept. 1, 1989, titled "Pressure Venting Closure", now U.S. Pat. No. 4,993,572 and Ser. No. 402,211, filed Sept. 1, 1989, titled "Container Closure With Internal Channels For Water Washing", now abandoned.

BACKGROUND OF THE INVENTION

Closures of the so-called "floating disk" type have recently been developed for use in the vacuum packing of food products. Such closures have a shell which threads onto a container and which holds an axially movable or "floating" disk that forms the seal with the container finish. The container is partially evacuated above the food product, and pressure differential force acts downwardly on the disk to hold it in sealing engagement with the container. Normally it is this differential pressure force which maintains the seal, more than any force applied by the closure shell to the disk. Depending upon the degree of vacuum and the area of the container mouth, this downward force can be so large as to make it undesirably difficult to lift the disk to break the vacuum.

In order to facilitate lifting the disk to break the vacuum, it is known to provide lifting means on the inside of the closure shell which, as the closure is twisted to open the container, is moved upward toward the disk and comes into engagement with the edge of the disk to lift it to break the vacuum. In some closures the upper end or ends of the internal thread or threads on the shell engage and lift the disk. However, because of the angulation of the threading the upper thread end engages the disk only over a very small area. Therefore considerably greater pressure must be applied through the small thread end area in order to overcome the downward force on the disk. This can require excessive opening torque and can result in deformation of the disk. Especially in the case of a single start or a two start thread, this area is not always sufficient to prevent the thread end from stripping past the disk (which is held down by vacuum), leaving the disk behind on the container finish instead of being lifted by the thread end.

To avoid that problem, it is also known to utilize lifting means on the inside of the skirt above the upper end of the shell threads. These means are a continuous or interrupted bead which engages a large portion or all of the periphery of the disk, rather than just localized points, so that the disk can be more positively lifted to break the vacuum. The lifting bead in such a closure is positioned above the external threads of the container so that the container threads do not interfere with the upward movement of the bead as the closure is twisted on the container. Such a floating disk closure is shown in Szczesniak U.S. Pat. No. 4,770,306.

Because such a closure must move axially before the bead engages and lifts the disk, the sidewall heights of the closure and container finish have heretofore been significantly greater than those of a corresponding vacuum sealing closure having an integral cover rather than a floating disk; the "float" has increased the sidewall height of the cap skirt and the container finish.

The provision of tamper evidencing means on a floating disk closure usually requires still more vertical height. Usually such means respond to twisting of the closure by rupture or break-off of a band or other easily visible feature; if such a rupture or break is visible while the product is on the shelf, tampering is apparent. As it is turned, a closure having a tamper evidencing means should first break the tamper evidencing means, and then after further turning, lift the disk. (It is desirable to have the tamper evidencing means break before the disk is lifted in order to insure that the possible tampering will be made evident even before the vacuum could have been broken.) Thus the provision of tamper evidencing means further increases the overall height of floating disk closures. A closure having both tamper evidencing means and a floating disk has heretofore had a relatively large "aspect ratio" or vertical height for a given diameter, in comparison to a corresponding closure without those features. In consequence of the greater height, relatively more material has been required for such a closure and container.

BRIEF DESCRIPTION OF THE INVENTION

It has been a purpose of this invention to provide a floating disk closure, with or without tamper evidencing means, having a relatively low height so as to require less material than other floating disk closures, while still providing positive lifting of the disk.

The closure of this invention has a shell with a lifting bead for engaging and lifting an insert disk. In contrast to previous closures, however, the bead is different and is located differently on the skirt in relation to the external thread or threads of the container. When the closure is in sealing position on the container, the bead is situated below the top of the external threading of the container, rather than above it. Also, the bead has an internal diameter which is sufficiently large that it can move upwardly past the threading on the container without that threading significantly impeding its upward travel as the closure is unscrewed. The inside diameter of the internal thread on the closure is sufficiently smaller than that of the bead that the internal threading, but not the bead, coacts with the threading of the container. At its upper end the closure threading merges into the bead and does not extend upwardly beyond it. The disk is lifted by engagement with the bead, providing a more positive lift than can be attained by the thread end or ends alone. The overall height of the closure and container finish can thereby be reduced and less material used.

DETAILED DESCRIPTION

Figure 1:
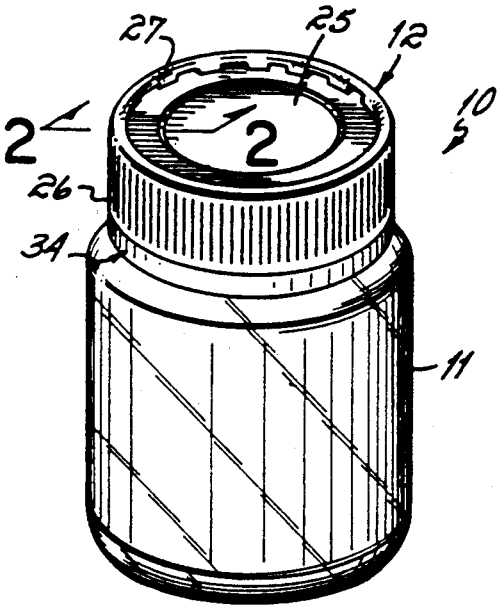
FIG. 1 is a perspective view of a container having a low height closure in accordance with a preferred embodiment of the invention.

The package 10, shown in FIG. 1, comprises a container 11 and a closure 12. Container 11 has an upper or finish portion 15 with one or more external threads 16 and a sealing rim 17 at the top. Below the threads 16 the finish has an annular locking rib 18 with a downwardly facing locking surface 19. (As will be seen, the function of locking rib 18 is to cause a tamper evidencing means to be ruptured when the closure is being opened.) Closure 12 is a composite closure having a separately formed top or insert disk 25 which is received by and carried within a surrounding shell 26. Shell 26 comprises a top lip 27 which overlaps the edge of insert disk 25, and a cylindrical skirt 28 having one or more internal threads 29 which cooperate with the external threading 16 of container 11.

In the embodiment shown disk 25 has a top surface 51 and a peripheral downturned flange 52 with a lower edge 53. A gasket 54 or liner is seated on or adhered to the insert disk to form a seal with the container rim 17.

Closure 12 preferably has tamper evidencing means in the form of a band 34 which is frangibly attached around a lower edge 35 of skirt 28. In the embodiment shown, tamper evidencing band 34 is connected to skirt 28 by small bridges 38. A peripheral score line 39 separates the band from the skirt except at the bridges 38. Band 34 has a band retainer 42 around its lower edge which in use position extends upwardly and inwardly from the lower edge of band 34 to engage container surface 19, beneath locking bead 18, when the closure is twisted toward opening. A preferred type of tamper evidencing means for use in connection with this invention is disclosed in application Ser. No. 401,966, filed Sept. 1, 1989, titled "Tamper Indicating Closure Having Retaining Hoop With Relief Windows," now U.S. Pat. No. 4,978,316, the disclosure of which is incorporated herein by reference. However, it should be noted that while the invention is desirably used in connection with some form of tamper evidencing means, it is not limited to such use and can be used in their absence.

Figure 3:
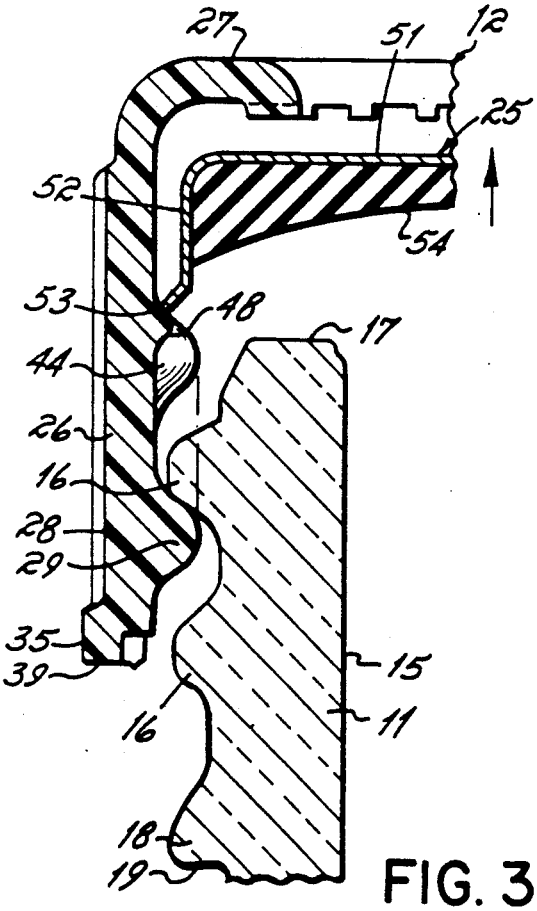
FIG. 3 is a section similar to FIG. 2, but shows the container shell lifting the disk.
Figure 4:
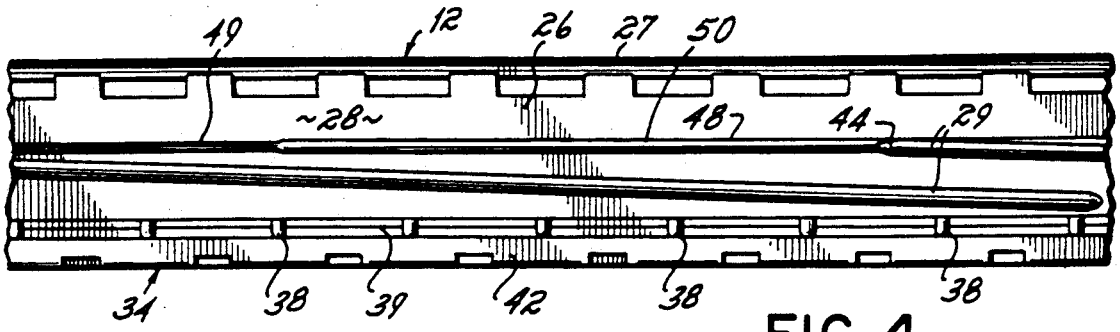
FIG. 4 is a developed view of the inside of a closure skirt with a single start internal thread.
Figure 5:
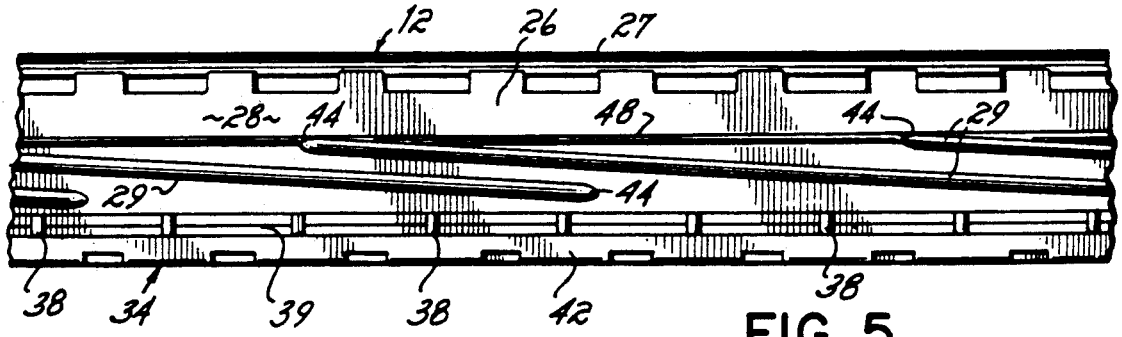
FIG. 5 is a developed view of the inside of a closure skirt with a double start thread.

Different exemplary forms of closure internal threading are shown in developed form in FIGS. 4 and 5. The principles of the invention are useful in connection with both single start (continuous) and multiple start (discontinuous) threads, and as used herein the term "thread" is meant to include both types. FIG. 4 shows a single start thread on the closure, and FIG. 5 a two start thread. The single start thread lies at a relatively shallow angle to horizontal and usually extends a full 360° around the inside of the skirt. The double threads of FIG. 5 typically lie at a steeper angle to horizontal and may each extend circumferentially for about 180°. The internal thread 29, single or multiple start, terminates at a feathered upper edge 44 (see FIGS. 4 and 5). The internal diameter of internal thread 29 must, of course, be less than the external diameter of the corresponding external threading 16, so that the threads will interengage as shown in FIGS. 2 and 3.

Skirt 28 has a disk lifting bead 48 on its inside surface. It is important that this bead 48 lie at the upper end 44 of the shell threading 29, that is, the shell threading 29 must not extend upwardly of bead 48 and should preferably blend or fair into bead 48. Bead 48 extends inwardly past the edge of disk 25, that it, its internal diameter is less than that of the disk, so that bead 48 will engage the disk when the closure is turned to remove it and thereby lift the disk and break the vacuum. The inside diameter of bead 48 should be as small as is consistent with clearing the external threads, so as to provide a positive lift on disk 25. In the two start embodiment of FIG. 5, the bead is of uniform inside diameter around its entire circumference, because the two opposite upper ends of the external threads provide more help to lift the disk than a single thread end. In the single start embodiment, bead inside diameter is preferably larger in one circumferential portion 49 to provide clearance where the external thread transverses it during opening. The bead inside diameter is smaller (the bead projects farther inwardly below the disk) in the circumferential portion 50 where the external thread 29 does not traverse it.

Figure 2:
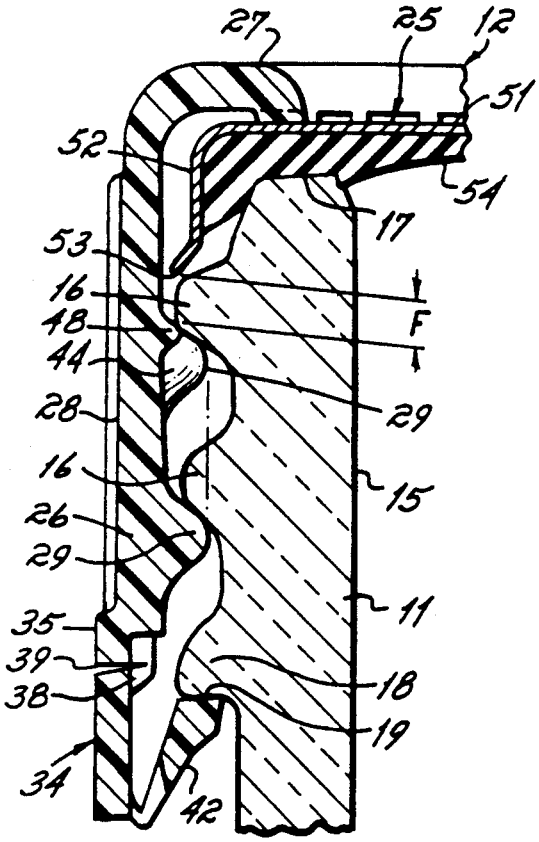
FIG. 2 is an enlarged section taken on line 2—2 of FIG. 1, showing the insert disk in sealing position on the container, before the shell has been turned to lift the disk.

It can be seen that disk 25 is captured within the shell 26 between top lip 27 and bead 48, and that a certain amount of floating movement, designated by F in FIG. 2, can occur before the bead 48 comes into engagement with the lower edge 53 of the disk. As closure shell 26 is turned to open the container, the closure rides up on container threads 16 and bead 48 comes into contact with the lower edge 53 of disk 43 and begins to exert a lifting force on the insert disk. Lifting bead 48 engages disk lower edge 53 around its periphery, thereby avoiding uneven force concentration and stripping of the threads past the disk without removing it.

In accordance with this invention, the external (container) threading 16 extends upwardly past bead 48 when the closure is in sealing position on the container (see FIG. 2). The inside diameter of bead 48 is sufficiently large that the external threading 16 of the container does not prevent upward translation of the bead 48 past it as the shell is turned. (Bead 48 may wipe across external threading 16, provided the closure can still be turned easily.)

When the container has been evacuated and sealed, the atmospheric pressure above disk 25 exceeds the pressure beneath the disk, and a net downward pressure differential force acts on the disk and holds gasket 54 in sealing engagement with container rim 17. The top lip 27 of the closure may engage or press on the top of the disk but the seal is primarily maintained by the pressure differential rather than by force of the lip.

As can be seen in FIG. 2, in sealed position the upper end 44 of the external (container) threading 16 preferably terminates closely below the lower edge 53 of disk flange 52. In comparison to a floating disk closure in which the external threading does not extend vertically above the lifting bead, the sidewall height of both the closure and the container are reduced so that less material is required.

Preferably bead 48 is continuous so as to form a seal with lower edge 53 of the disk when it engages and lifts the disk. This prevents foreign particles from being swept in by what would otherwise be an inrush of air from above the disk as the vacuum is broken.

It is desirable that the tamper evident band 34 be broken before bead 48 can engage and lift the disk to break the vacuum. This in turn requires that the closure be unscrewed sufficiently to bring band retainer 42 into engagement with surface 19 of locking rib 18 to cause the frangible means 38 to break, before bead 48 engages and lifts the disk. If tamper evidencing band 34 has been broken and fully or partially separated from closure 11, the possibility of tampering will be apparent even if the seal has not actually been broken. In this manner insert disk 25 cannot be lifted without first causing the tamper evidencing band to be separated.

It is desirable, although not necessary, that the closure of this invention be used together with slots for water washing, preferably as disclosed in my co-pending application Serial No. 402,211 previously referred to. It is further desirable, but not necessary, that this invention be used together with the pressure venting structure disclosed in my co-pending application Ser. No. 401,999, previously referred to. However, the invention may be used without either of those structures.

Having described the invention, what is claimed is:

1. A composite closure comprising a shell and an insert disk which is axially movable within said shell, said shell having at least one internal thread which is cooperable with an external thread of a container, said shell further having an internal bead spaced axially below said disk when said disk seals a container, said shell when turned to open a container moving said bead relatively upward and into engagement with said disk to lift said disk, said bead lying at the upper end of said internal thread, said bead lying below the top of the external thread of said container when said closure seals said container, said bead having an inside diameter greater than that of said internal thread and large enough that said bead can move axially past the external thread of said container when said internal thread is being turned along said external thread.

2. The closure of claim 1 wherein the inside diameter of said bead is at least as large as the outside diameter of the thread-engaging surface of said internal thread of said closure.

3. The closure of claim 1 wherein said internal thread is faired into said bead.

4. A composite closure comprising a shell and an insert disk which is axially movable within said shell, said shell having at least one internal thread which is cooperable with an external thread of a container, said shell further having an internal bead spaced axially below said disk when said disk seals a container, said shell when turned to open a container moving said bead relatively upward and into engagement with said disk to lift said disk, said bead lying below the top of the external thread of said container when said closure seals said container, said bead having an inside diameter greater than that of said internal thread and large enough that said bead can move axially past the external thread of said container when said internal thread is being turned along said external thread, said bead further having circumferential portions of different inside diameters, including a portion of larger diameter where the external thread traverses the bead during opening and a portion of smaller diameter where the external thread does not traverse the bead during opening.

5. The closure of claim 1 wherein said closure has a top lip which projects inwardly from said shell, and said insert disk is axially movable between said bead and said top lip.

6. The closure of claim 1 wherein said insert disk has a downturned peripheral flange with a lower edge, and said bead is axially movable into engagement with said lower edge of said flange to lift said disk.

7. The closure of claim 1 wherein said insert disk has a gasket for sealing a container.

8. The closure of claim 1 wherein said internal thread is a continuous thread.

9. The closure of claim 1 wherein said closure has multiple threads.

10. The closure of claim 1 wherein said bead is continuous and uninterrupted.

11. The closure of claim wherein said bead lies in a plane perpendicular to the central axis of said closure.

12. The closure of claim 1 further including tamper evidencing means around said shell.

13. A package comprising a composite closure having at least one internal thread and a container having a finish with at least one external thread, said closure comprising a shell and an insert disk received in said shell and forming a seal with said finish of said container, said disk being axially movable within said shell as said shell is turned on said container, said shell having an internal bead spaced below said disk, said shell when turned to open said container moving said bead upward into engagement with said disk to lift said disk from said finish, said bead having an inside diameter permitting it to be moved upward past said external thread of said container, said inside diameter being greater than the inside diameter of said internal thread of said closure, said external thread extending upwardly beyond said bead and internal thread, and extending closer to said disk than said internal thread when said closure seals said container.

14. The package of claim 13 wherein said internal thread terminates upwardly at said bead.

15. The package of claim 13 wherein said internal thread is faired into said bead.

16. The package of claim 13 wherein said bead has circumferential portions of different inside diameters, including a portion of larger diameter where the external thread traverses the bead during opening and a portion of smaller diameter where the external thread does not traverse the bead during opening.

17. The package of claim 13 wherein said closure has a top lip which projects inwardly from said shell, and said insert disk is axially movable between said bead and said top lip.

18. The package of claim 13 wherein said insert disk has a downturned peripheral flange with a lower edge, and said bead is axially movable into engagement with said lower edge of said flange to lift said disk.

19. The package of claim 13 wherein said insert disk has a gasket for sealing a container.

20. The package of claim 13 wherein said internal thread is a continuous thread.

21. The package of claim 13 wherein said closure has multiple threads.

22. The package of claim 13 wherein said bead is continuous and uninterrupted.

23. The package of claim 13 wherein said bead lies in a plane perpendicular to the central axis of said closure.

24. The package of claim 13 further including tamper evidencing means around said shell which ruptures when said shell is turned to open said package, said tamper evidencing means being ruptured by said turning before said bead lifts said disk.

* * * * *